US010916869B2

(12) United States Patent
Tatsumi et al.

(10) Patent No.: US 10,916,869 B2
(45) Date of Patent: Feb. 9, 2021

(54) PRESS-FIT TERMINAL

(71) Applicant: AISIN SEIKI KABUSHIKI KAISHA, Kariya (JP)

(72) Inventors: Masahiko Tatsumi, Kariya (JP); Shinya Imanaka, Kariya (JP); Yosuke Takata, Kariya (JP)

(73) Assignee: AISIN SEIKI KABUSHIKI KAISHA, Kariya (JP)

( * ) Notice: Subject to any disclaimer, the term of this patent is extended or adjusted under 35 U.S.C. 154(b) by 0 days.

(21) Appl. No.: 16/618,218

(22) PCT Filed: Mar. 2, 2018

(86) PCT No.: PCT/JP2018/007923
§ 371 (c)(1),
(2) Date: Nov. 29, 2019

(87) PCT Pub. No.: WO2018/220927
PCT Pub. Date: Dec. 6, 2018

(65) Prior Publication Data

US 2020/0119471 A1 Apr. 16, 2020

(30) Foreign Application Priority Data

May 31, 2017 (JP) ..... 2017-107802

(51) Int. Cl.
*H01R 13/42* (2006.01)
*H01R 12/58* (2011.01)
*H01R 9/16* (2006.01)

(52) U.S. Cl.
CPC ..... *H01R 12/585* (2013.01); *H01R 9/16* (2013.01)

(58) Field of Classification Search
CPC ..... H01R 12/58; H01R 12/585; H01R 9/16
(Continued)

(56) References Cited

U.S. PATENT DOCUMENTS 5,374,204 A 12/1994 Foley et al.
5,664,970 A 9/1997 Millhimes et al.
(Continued)

FOREIGN PATENT DOCUMENTS

JP 07192799 A1 7/1995
JP 2000505590 A1 5/2005
(Continued)

OTHER PUBLICATIONS

Notification of Transmittal of Translation of the International Preliminary Report on Patentability (Forms PCT/IB/338 and PCT/IB/373) and the Written Opinion of the International Searching Authority (Form PCT/ISA/237) dated Dec. 12, 2019, by the International Bureau of WIPO in corresponding International Application No. PCT/JP2018/007923. (9 pages).
(Continued)

*Primary Examiner* — Khiem M Nguyen
(74) *Attorney, Agent, or Firm* — Buchanan Ingersoll & Rooney PC

(57) ABSTRACT

The press-fit terminal includes a leading end portion, a base end portion and a connection portion. The connection portion includes a slit extending through from the front side to the rear side and a pair of conductive portions opposed to each other across the slit. An outer contour of each one of the pair of conductive portions in the connection portion includes an outer first portion in which a first arcuate portion formed arcuate and a first straight portion formed straight are disposed in this order from the center portion toward the base end portion. Each one of the pair of first straight portions is formed with a tilt by an angle ranging from 5 degrees or more to 10 degrees or less relative to a center axis of the slit.

4 Claims, 5 Drawing Sheets

(58) Field of Classification Search
USPC ..... 439/733.1, 751
See application file for complete search history.

(56) References Cited

U.S. PATENT DOCUMENTS

| | | | | |
|---|---|---|---|---|
| 7,591,655 | B2 * | 9/2009 | Fedder | H01R 12/585 439/108 |
| 7,753,742 | B2 * | 7/2010 | Fedder | H01R 12/585 439/751 |
| 8,092,262 | B1 * | 1/2012 | Frederick | H01R 12/585 439/751 |
| 2014/0213080 | A1 | 7/2014 | Miyake | |

FOREIGN PATENT DOCUMENTS

| | | | |
|---|---|---|---|
| JP | 2007012279 | A1 | 1/2007 |
| JP | 2008053082 | A1 | 3/2008 |
| JP | 4084265 | B2 | 4/2008 |
| JP | 2008165987 | A1 | 7/2008 |
| WO | 2008038331 | A1 | 4/2008 |

OTHER PUBLICATIONS

International Search Report (PCT/ISA/210) dated Mar. 27, 2018, by the Japanese Patent Office as the International Searching Authority for International Application No. PCT/JP2018/007923.
Written Opinion (PCT/ISA/237) dated Mar. 27, 2018, by the Japanese Patent Office as the International Searching Authority for International Application No. PCT/JP2018/007923.

* cited by examiner

PRESS-FIT TERMINAL

TECHNICAL FIELD

This invention relates to a press-fit terminal, when pressed into a through hole, rendered into a conductive state with an inner face of the through hole.

BACKGROUND ART

A press-fit terminal is employed as a connector for use in various kinds of electronic devices. The press-fit terminal is configured to be pressed into a through hole formed in e.g. a substrate of various electronic devices to be electrically connected therewith. Conventionally, various shapes have been proposed for its press-in portion.

PTL 1 discloses, as a press-fit terminal (a "compliant portion" in the document), a technique in which there is provided a vertically elongate slit having, in its outer circumference, an inner contour formed by connecting opposed ends of a pair of straight portions parallel with an axis to each other via semi-circles, and a center portion of the slit in the longitudinal direction is located on more leading end side than a portion of an arcuate-shaped outer contour having maximal width. With this arrangement, a width between the inner contour and the outer contour located on more base end side than the center portion of the slit is set greater than a width between the inner contour and the outer contour located on more leading end side than the center portion of the slit. It is described that the above arrangement provides protection against buckling of the terminal at time of pressing-in into the through hole.

PTL 2 discloses, as a press-fit terminal, a technique in which the press-fit terminal has an oval-shaped slit, a width between an inner contour formed in the outer circumference of the slit and an arcuate-shaped outer contour is made substantially constant, and a tapered outer contour (a tapered portion) is formed in an auxiliary slit with the leading end side of the slit being extended linear. It is described that with the above arrangement, as the tapered portion comes into contact with an opening end of a through hole, a pressing-in force is maintained constant in an initial stage of pressing-in operation to the through hole.

Further, PTL 3 discloses, as a press-fit terminal, a technique in which the press-fit terminal has a vertically elongate slit having its opposed ends curved in U-shape, a longitudinal center portion of the slit is located on more leading end side than a portion where an outer contour has its maximal width, and at a portion on slightly more base end side than the longitudinal center portion of the slit, there are formed a pair of outer contours ("pressure maintaining portions" in the document) extending parallel with the center axis of the slit. It is described that with the above arrangement, at time of pressing-in to a through hole, the pressure maintaining portions provide distribution of the stress and with reduction in the length of the pressure maintaining portions, generation of burrs is suppressed.

CITATION LIST

Patent Literature

PTL 1: Japanese Unexamined Patent Application Publication (Japanese Translation of PCT Application) No. 2000-505590

PTL 2: Japanese Unexamined Patent Application Publication No. 2008-53082

PTL 3: Japanese Unexamined Patent Application Publication No. 2008-165987

SUMMARY

Technical Problem

With a press-fit terminal, in addition to a pressing-in load occurring at the initial stage of pressing-in operation into a through hole of a substrate, a pressing-in load occurs also at time of subsequent pressing-in operation and time of eventual completion thereof. With such press-fit terminal, depending on its shape, the pressing-in load at time immediately before completion of the pressing-in operation may sometimes become larger than the initial pressing-in load and such increased pressing-in load increases the possibility of damage to the substrate. For this reason, it is desired that the pressing-in load of the press-fit terminal be suppressed not only at the initial stage of the pressing-in operation to the through hole, but also throughout the period until completion of the pressing-in operation.

In the press-fit terminal of PTL 1, the outer contour at the center portion is bulged whereas the inner contour is formed of straight lines parallel to the axis, so the width is increased in the vicinity of the center of the terminal. As a result, when the terminal center comes to the entrance of the through hole, a significant load occurs, so there is the risk of inviting damage to the substrate and buckling of the terminal.

In the press-in terminal of PTL 2, the pressing-in load at the initial stage is suppressed by the contact of the tapered portion with the opening end of the through hole, but the outer contour is bulged in an arcuate shape on more base end side than the terminal center. Thus, after the terminal center comes to the entrance of the through hole, a significant load occurs, so there is the risk of inviting damage to the substrate and buckling of the terminal.

In the press-in terminal of PTL 3, as the longitudinal center portion of the slit is offset toward the leading end side relative to the portion where the outer contour has its maximal width, the rigidness on the leading end side is decreased. Thus, when the linear-shaped pressure maintaining portion comes into contact with the through hole, the leading end side of the pressure maintaining portion will be deformed to the inner side more than the base end side. As a result, in addition to inability to secure a sufficient contact area of the pressure maintaining portions, a significant pressing-in load will occur prior to completion of the pressing-in operation with the base end side of the pressing-in maintaining portion acting as an angular portion, so that damage of the substrate and buckling of the terminal can be invited.

In view of the above-described states of the art, there is a need for a press-fit terminal capable of preventing damage of the substrate and buckling of the terminal through effective suppression of the pressing-in load until completion of the pressing-in operation into the through hole of the substrate.

Solution to Problem

According to a characterizing feature of a press-fit terminal relating to the present invention, the press-fit terminal comprises:

a leading end portion to be inserted into a through hole formed in a substrate, the leading end portion having a smaller width than a width of the through hole;

a base end portion provided on the opposite side to the leading end portion; and a connection portion provided between the leading end portion and the base end portion to be pressed-into the through hole;

wherein the connection portion includes a slit extending through from the front side to the rear side, and a pair of conductive portions opposed to each other across the slit;

wherein a width of the connection portion is maximal at a center portion thereof between the leading end portion and the base end portion and progressively decreases from the center portion toward the leading end portion and toward the base end portion;

wherein an outer contour of each one of the pair of conductive portions in the connection portion includes respectively an outer first portion in which a first arcuate portion formed arcuate to bulge to the outer side and a first straight portion formed straight are disposed in this order from the center portion toward the base end portion and an outer second portion extending from the center portion toward the leading end portion;

wherein an inner contour of the pair of conductive portions in the connection portion includes an inner first portion extending from the center portion toward the base end portion and an inner second portion extending from the center portion toward the leading end portion;

wherein the inner first portion is formed parallel with the outer first portion; and wherein each one of the pair of first straight portions is formed with a tilt by an angle ranging from 5 degrees or more to 10 degrees or less relative to a center axis of the slit.

With the above-described arrangement, in the press-fit terminal, the width of the connection portion is maximal at the center portion and progressively decreases from the center portion toward the leading end portion and toward the base end portion, respectively. And, in the outer contour of each one of the pair of conductive portions in the connection portion, a first arcuate portion and a first straight portion are disposed in this order from the center portion toward the base end portion. Therefore, the connection portion extending from the center portion toward the base end portion has its width firstly gently decreased and then decreased linearly. With this, when the press-fit terminal is pressed into a through hole having an appropriate diameter, upon passage of the center portion through the through hole entrance, the portion on the base end side relative to the center portion will be held in a reliable manner within the through hole. Namely, on the more base end side than the center portion in the press-in stroke of the press-fit terminal, there will hardly exist any portion which can contact the entrance of the through hole. As a result, the pressing-in load at the time of completion of the pressing-in operation will be suppressed, so that damage of the substrate can be suppressed.

Further, in the connection portion, the inner first portion extending from the center portion toward the base end side and the outer first portion are formed parallel with each other, so the width of the conductive portion is made constant, thus eliminating any portion subjected to local reduction in its strength at the time of through hole pressing-in operation, so buckling of the terminal due to pressure load can be prevented. Incidentally, in the press-fit terminal, in case the first straight portion of the outer first portion in the connection portion is tilted with a predetermined angle relative to the center axis, if this angle is too small, the connection portion will tend to be maintained under the pressed-in state at the first straight portion as well, so that increase of the pressing-in load of the press-fit terminal cannot be suppressed. On the other hand, if this angle is too large, the length of the slit on the side of the base end portion cannot be secured sufficiently since the inner first portion and the outer first portion in the connection portion extending from the center portion toward the base end portion are parallel with each other. Then, the rigidness of the connection portion increases on the side of the base end portion, so increase of the pressing-in load of the press-fit terminal cannot be suppressed. Therefore, according to the inventive arrangement described above, in order to appropriately suppress incase in the pressing-in load of the press-fit terminal, each one of the pair of first straight portions is formed with a tilt by an angle ranging from 5 degrees or more to 10 degrees or less relative to a center axis of the slit. In this way, the press-fit terminal having the inventive arrangement can suppress the pressing-in load until completion of a pressing-in operation into a through hole of a substrate, thus being capable of preventing damage to the substrate and buckling of the terminal.

According to a further characterizing feature:

the outer second portion is formed of an outwardly bulging arc having a center of curvature on a virtual plane that is perpendicular to the center axis and extends through the center portion;

in the inner second portion, a second arcuate portion formed arcuate and parallel with the outer second portion and a second straight portion formed straight are disposed in this order from the center portion toward the leading end portion; and one pair of the second straight portions extend toward the leading end portion from a position where an angle formed by extension lines of tangents to a pair of the second arcuate portions across the center line therebetween ranges from 10 degrees or more to 25 degrees or less, with keeping this angle.

When the press-fit terminal is pressed into a through hole, if a reaction force is applied to the outer second portion of the connection portion at the entrance of the through hole, this outer second portion of the connection portion will be deformed to be curved toward the centerline of the slit. In this, if the outer second portion were formed straight, the curved shape would be concave outwards, so the pressing-in load will be increased by the straight angular portion. On the other hand, in the case of the inventive arrangement described above, since the outer second portion extending from the center portion toward the leading end portion in the connection portion is formed arcuate bulging outwards and the first arcuate portion of the outer first portion connected to the outer second portion is also formed arcuate, so no angular portion exists. Therefore, even when such reaction force is applied to the outer second portion in the connection portion at the entrance of the through hole, warping of the outer second portion as a whole toward the centerline of the slit is prevented. Consequently, the pressing-in load of the press-fit terminal applied to the substrate can be reduced.

Moreover, in the inner second portion, a second arcuate portion formed arcuate and parallel with the outer second portion and a second straight portion formed straight are disposed in this order from the center portion toward the leading end portion and the second straight portion extends at a predetermined angle toward the leading end portion. Thus, the pair of conductive portions are formed narrower as extending toward the leading end portion. With this, the leading end area in the connection portion which comes first into contact with the through hole can easily be deformed, so that the pressing-in load of the press-fit terminal applied to the substrate at the initial stage of the pressing-in operation can be suppressed.

According to a still further characterizing feature, in the slit, a distance thereof from the center portion toward the leading end portion is set to be 1.1 folds or more but less than 1.8 folds or less of a distance from the center portion toward the base end portion.

With this inventive arrangement, the slit of the press-fit terminal is formed narrowly elongate with the distance from the center portion of the connection portion toward the leading end portion being set longer than the distance from the center portion toward the base end portion. With this arrangement, there occurs no excessive spreading apart of the through hole by the conductive portion, so that the press-fit terminal can be pressed into the through hole smoothly.

According to a still further characterizing feature, in the slit, the distance from the center portion toward the base end portion is set to range from 0.9 mm or more to 1.6 mm or less.

In the slit of the press-fit terminal described above, relative to the center portion of the connection portion, the leading end portion is set longer by a predetermined ratio than the base end portion. Further, as described in the inventive arrangement, the distance from the center portion toward the base end portion is set to range from 0.9 mm or more to 1.6 mm or less. With this, the range of the distance from the center portion toward the leading end portion in the slit is fixedly determined, so that the setting of the length of the slit relative to the center portion is made easy. Further, by adjusting the length and the position of the slit within respective predetermined ranges, an elastic force at the center portion of the connection portion can be set appropriately.

DESCRIPTION OF EMBODIMENTS

Next, embodiments of the present invention will be explained with reference to the accompanying drawings.

Figure 1:
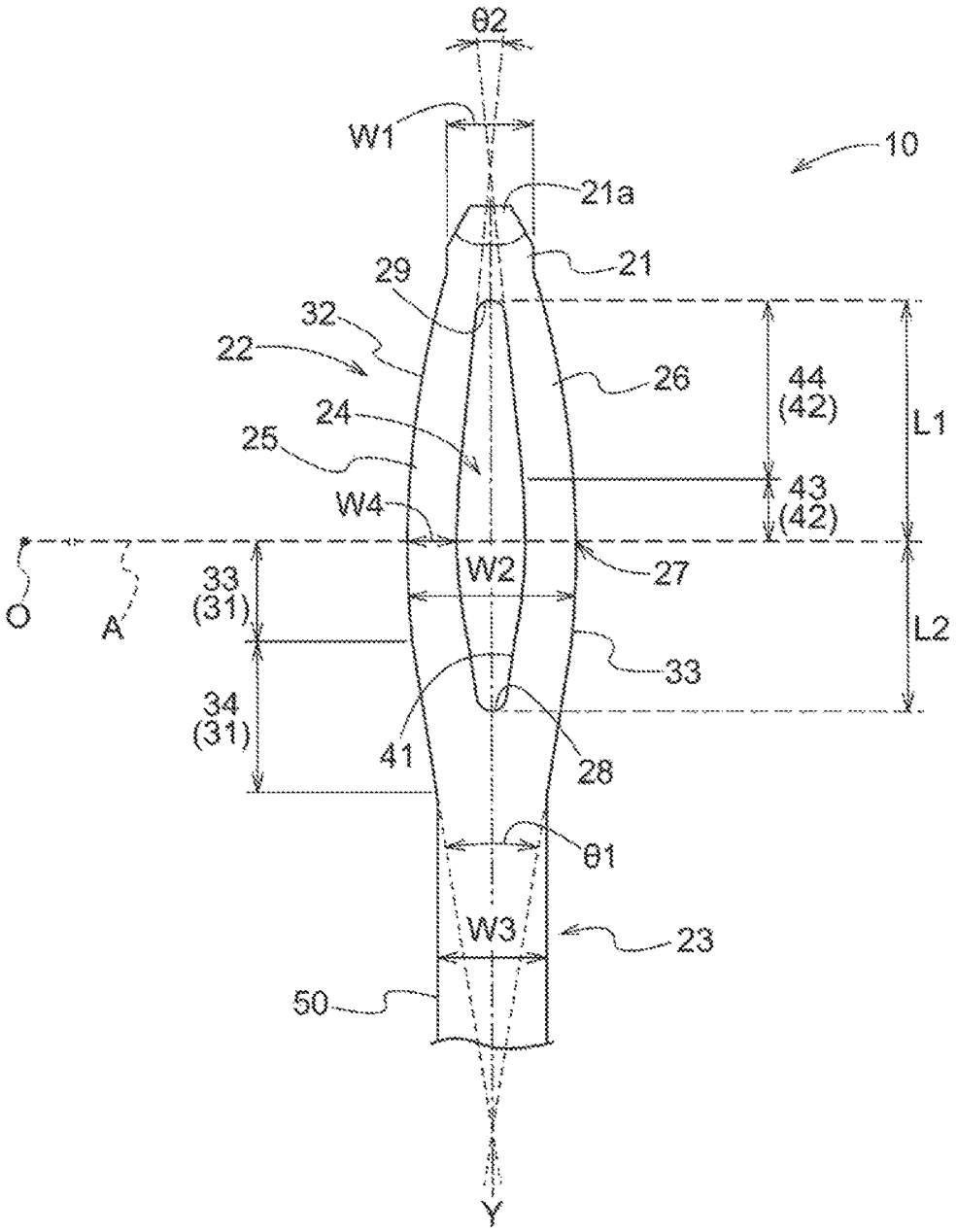
FIG. 1 is a front view of a press-fit terminal according to an embodiment.
Figure 2:
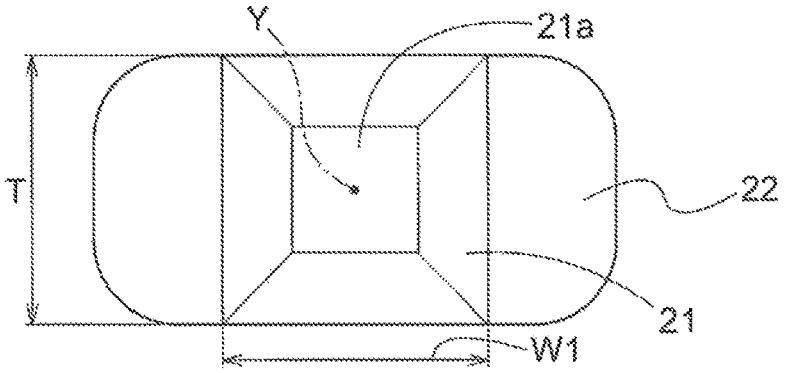
FIG. 2 is a plan view of the press-fit terminal according to the embodiment.
Figure 3:
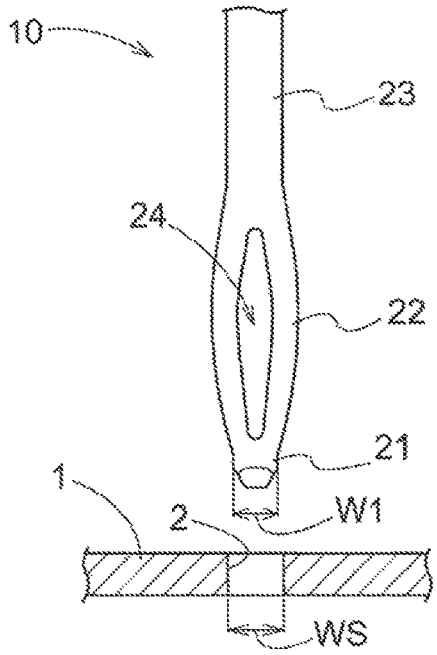
FIG. 3 is a view showing the press-fit terminal to be pressed into a substrate.

A press-fit terminal 10 shown in FIG. 1 and FIG. 2 is configured to be pressed into a through hole 2 formed in a substrate 1 to be electrically connected to this substrate 1, as shown in FIG. 3, for example.

The press-fit terminal 10 is a plate-like body formed by pressing a highly electrically conductive metal wire such as copper, copper alloy (e.g. phosphor bronze) and has a constant thickness. The press-fit terminal 10 can be used without any surface treatment. However, it is preferred that a conductive membrane of e.g. tin plating be formed on its surface. As shown in FIG. 1, the press-fit terminal 10 is formed elongate as a whole and includes a leading end portion 21 provided on one longitudinal end side, a base end portion 23 provided on the other longitudinal end side opposite to the leading end portion 21, and a connection portion 22 provided between the leading end portion 21 and the base end portion 23. The leading end portion 21 has a width W1 (see FIG. 3) smaller than a width WS of the through hole 2. The connection portion 22 is pressed-into the through hole 2.

The connection portion 22 includes a slit 24 extending through the front and rear sides, and a pair of conductive portions 25, 26 opposed to each other across the slit 24 therebetween. FIG. 1 shows a center axis Y of the press-fit terminal 10 which extends from the base end portion 23 toward the leading end portion 21.

The leading end portion 21 is tapered toward a leading end 21*a*. The leading end portion 21 is configured with the width W1 thereof being sized equal to a thickness T (see FIG. 2) of the press-fit terminal 10. Namely, as shown in FIG. 2, the leading end portion 21 is shaped like a square as seen in a plan view. With this, in the leading end portion 21, the distances of the space formed with the through hole 2 in the width direction and in the thickness direction are made equal, so this leading end portion 21 can be pressed into the appropriate area at the center of the through hole 2 easily. A width W2 of the connection portion 22 is maximal at a center portion 27 between the leading end portion 21 and the base end portion 23 and progressively decreases from the center portion 27 toward the leading end portion 21 and toward the base end portion 23, respectively. The base end portion 23 has an outer contour 50 formed straight and parallel with a center axis Y and has a constant width W3. This width W3 of the base end portion 23 is arranged to agree with a sum of widths W4 of the conductive portions 25, 26 at the center portion 27. Incidentally, the width W3 of the base end portion 23 may be set equal to or greater than the sum of the widths W4 at the center portion 27. With this arrangement, the base end portion 23 does not cause reduction in the amount of allowable electric current and the strength of the base end portion 23 becomes greater than the strength of the conductive portions 25, 26 having elasticity, so that occurrence of buckling of the base end portion 23 can be prevented.

The outer contour of each one of the pair of conductive portions 25, 26 in the connection portion 22 respectively includes an outer first portion 31 extending from the center portion 27 toward the base end portion 23 and an outer second portion 32 extending from the center portion 27 toward the leading end portion 21. In the outer first portion 31, a first arcuate portion 33 formed arcuate and a first straight portion 34 formed straight are disposed in this order from the center portion 27 toward the leading end portion 23.

The inner contour of each one of the pair of conductive portions 25, 26 in the connection portion 22 respectively includes an inner first portion 41 extending from the center portion 27 toward the base end portion 23 and an inner second portion 42 extending from the center portion 27 toward the leading end portion 21, and the inner first portion 41 is formed parallel with the outer first portion 31. Namely, the width between the outer first portion 31 and the inner first portion 41 is constant and equal to the width W4 at the center portion 27. With this arrangement, the elasticity of the conductive portions 25, 26 between the outer first portion 31 and the inner first portion 41 can be made constant.

As the outer first portion 31 of the connection portion 22 includes the first arcuate portion 33 formed arcuate and the first straight portion 34 formed straight which are disposed in this order as provided in this embodiment, in the press-fit terminal 10, the outer contour of the connection portion 22 firstly becomes gently narrower from the center portion 27 toward the base end portion 23 and then becomes narrower linearly. With this, when the press-fit terminal 10 is pressed into the through hole 2 having an appropriate diameter, upon passage of the center portion 27 through the entrance of the through hole 2, the portion on the side closer to the base end portion 23 than the center portion 27 will be accommodated within the through hole 2. As a result, there will hardy exist any portion in the press-fit stroke of the press-fit terminal 10 that can contact the entrance of the through hole 2, so the pressing-in load of the press-fit terminal 10 at the time of completion of the pressing-in operation is suppressed.

In the press-fit terminal 10, in case the first straight portion 34 of the outer first portion 31 in the connection portion 22 is tilted with a predetermined angle relative to the center axis Y, if this angle is too small, in the connection portion 22, the first straight portion 34 will be under the pressed-in state inadvertently, so that increase of the pressing-in load of the press-fit terminal 10 cannot be suppressed. On the other hand, if this angle is too large, the length of the slit 24 on the side of the base end portion 23 cannot be secured sufficiently since the inner first portion 41 and the outer first portion 31 in the connection portion 22 extending from the center portion 27 toward the base end portion 23 are parallel with each other. Then, the rigidness of the connection portion 22 increases on the side of the base end portion 23, so increase of the pressing-in load of the press-fit terminal 10 cannot be suppressed.

Therefore, the first straight portions 34 are designed with an angle θ1 ranging from 10 degrees or more to 20 degrees or less across the center axis Y of the slit 24. Namely, each one of the pair of first straight portions 34 is formed with a tilt by an angle ranging from 5 degrees or more to 10 degrees or less relative to the center axis Y of the slit 24. With this arrangement, the pressing-in load of the press-fit terminal 10 can be suppressed appropriately.

The outer second portion 32 is formed of an outwardly bulging arc having a center of curvature O on a virtual plane A that is perpendicular to the center axis Y and extends through the center portion 27.

In the inner second portion 42, a second arcuate portion 43 formed arcuate and parallel with the outer second portion 32 and a second straight portion 44 formed straight are disposed in this order from the center portion 27 toward the leading end portion 21. One pair of the second straight portions 44 extend toward the leading end portion 21 from a position where an angle θ2 formed by extension lines of tangents to a pair of the second arcuate portions 43 across the center axis Y therebetween ranges from 10 degrees or more to 25 degrees or less, with keeping this angle.

In the slit 24, a distance L1 on the side of the leading end portion 21 relative to the center portion 27 is set to be 1.1 folds or more, but less than 1.8 folds or less of a distance L2 on the side of the base end portion 23. Namely, in this slit 24, the distance L1 from the center portion 27 to the leading end portion 21 is longer than the distance L2 from the center portion 27 to the base end portion 23. With this arrangement, in the process of the press-fit terminal 10 being pressed into the through hole 2 and rendered into a pressed-in state, the pressing-in load will rise gently. As a result, damage of the substrate 1 can be suppressed in the initial stage of the press-fit terminal 10 being rendered into the pressed-in state.

The distance L2 will be set from 0.9 mm or more to 1.6 mm or less, for example. In this way, in the slit 24, with setting of the distance L2 within a predetermined range in addition to setting of the ratio between the distance L1 and the distance L2, the range of the distance L1 too will be fixedly determined. With this, setting of the length of the slit 24 relative to the center portion 27 of the connection portion 22 is facilitated. Further, in the press-fit terminal 10, through adjustments of the length and the position of the slit 24 within respective predetermined ranges, the elasticity of the center portion 27 (conductive portions 25, 26) in the connection portion 22 can be set appropriately.

Example 1

Figure 4:
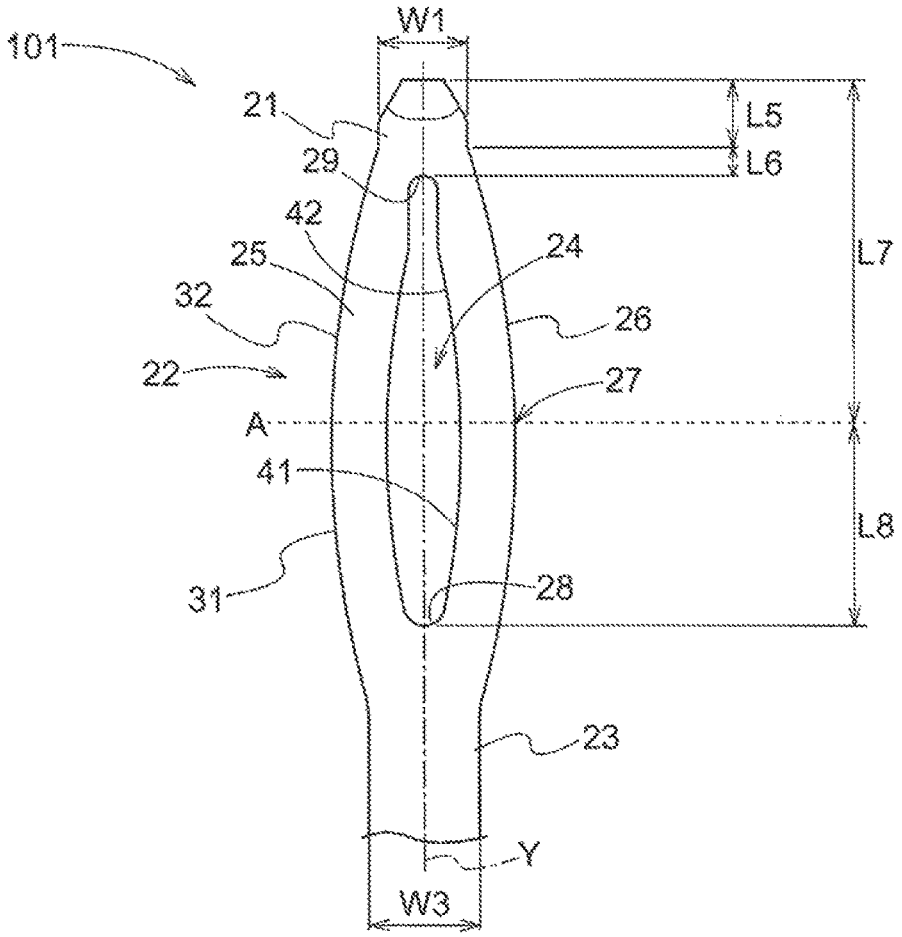
FIG. 4 is a front view of a press-fit terminal in Comparison Example 1.
Figure 5:
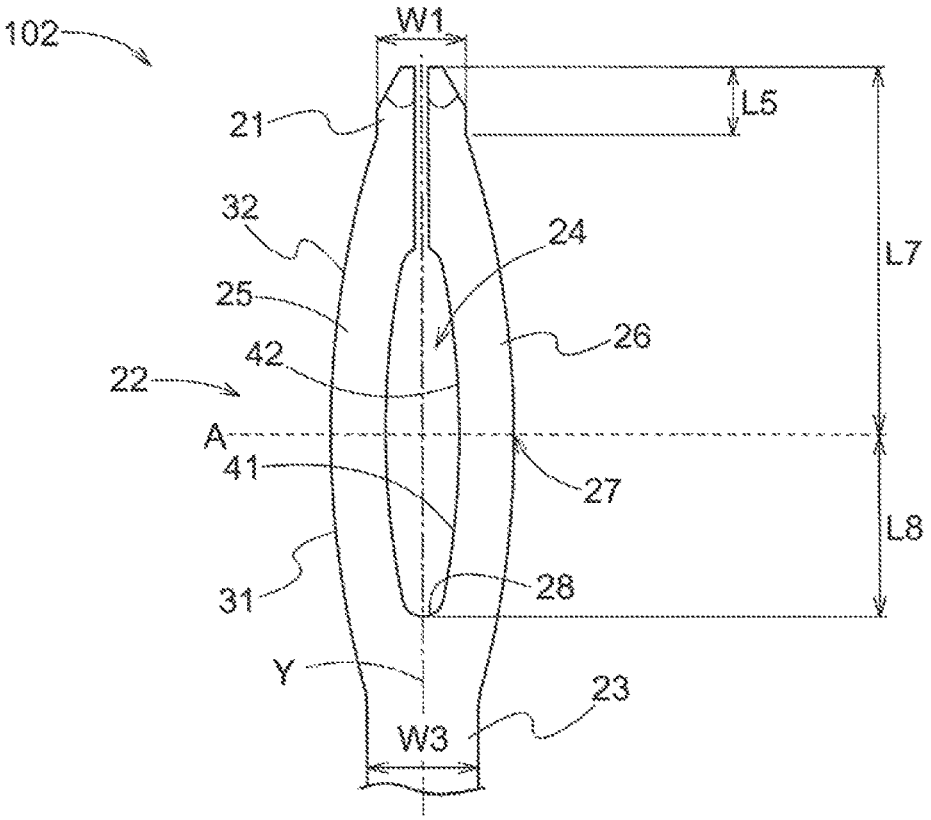
FIG. 5 is a front view of a press-fit terminal in Comparison Example 2.
Figure 6:
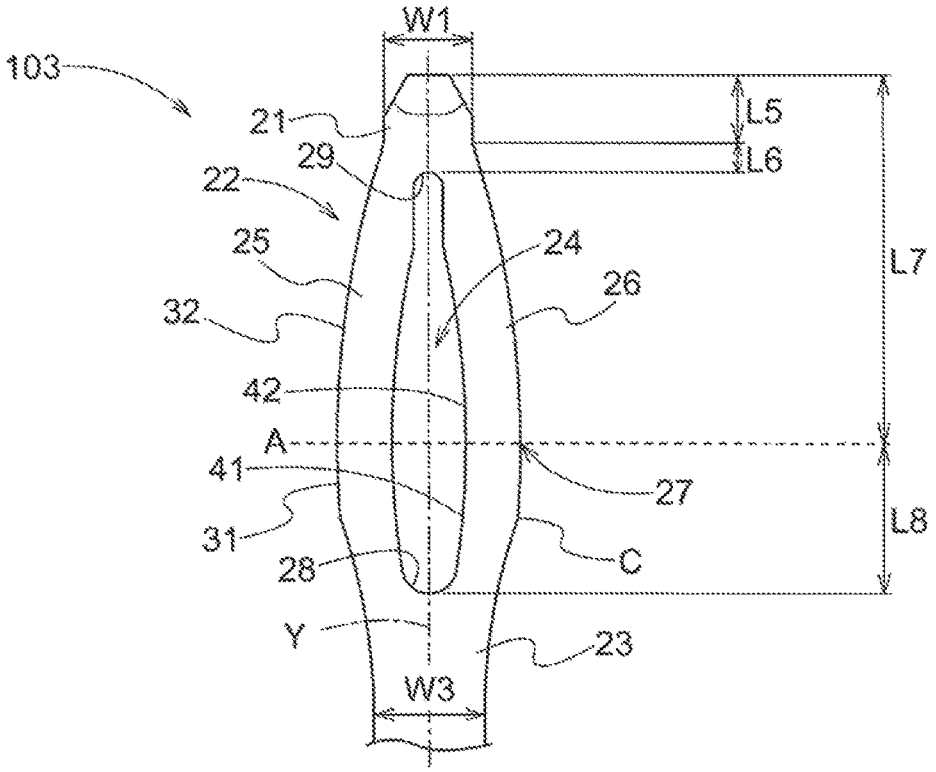
FIG. 6 is a front view of a press-fit terminal in Comparison Example 3.
Figure 7:
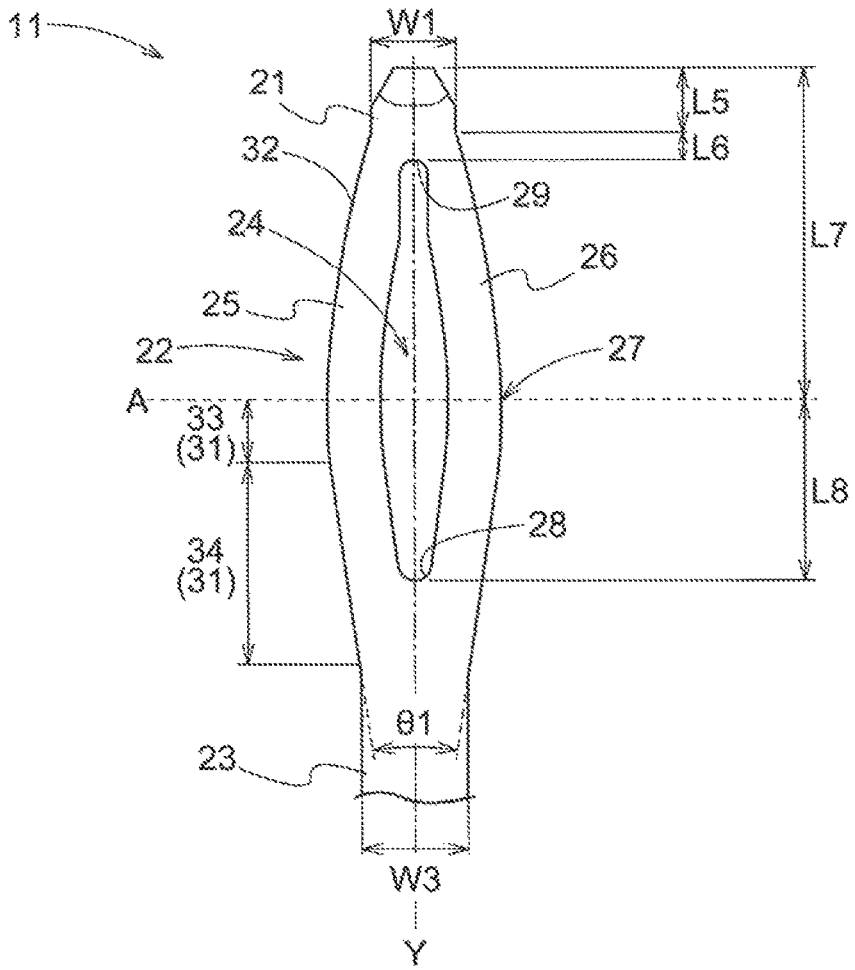
FIG. 7 is a front view of a press-fit terminal in Example 1.

Next, press-fit terminals according to Example 1 relating to the present embodiment and Comparison Examples 1-3 will be disclosed. Comparison Examples 1-3 (press-fit terminals 101-103) are shown in FIGS. 4-6. The press-fit terminal 11 of Example 1 is shown in FIG. 7. In Comparison Examples 1-3 and Example 1, the press-fit terminals are formed with using phosphor bronze, and both a width W1 and the thickness of the leading end portion 21 are 0.64 mm respectively in all the terminals. Incidentally, in Comparison Examples 1-3 and Example 1, the shape is adjusted so that the elasticities of the connection portions 22 are substantially same. Specifically, the elasticity of the connection portions 22 is defined as the load that completely collapses this connection portion 22 with increase of the load to the center portion 27. Then, the shapes are adjusted such that such loads are substantially same in Comparison Examples 1-3 and Example 1.

In Comparison Examples 1-3 and Example 1, distances L5-L8 are set in the direction along the center axis Y. L5 is the length of the leading end portion 21, L6 is the length from the rear end of the leading end portion 21 to the end 29 on the side of the leading end portion 21 of the slit 24. Further, L7 is the length from the leading end portion 21 to the center portion 27 of the connection portion 22, and L8 is the length from the center portion 27 to the end 28 on the side of the base end portion 23 of the slit 24.

The distance L5 is same throughout Example 1 and Comparison Examples 1-3, being set to 0.4 mm. The distance L6 is set same throughout Example 1 and Comparison Examples 1-3, being set to 0.3 mm. The distance L7 is set same throughout Example 1 and Comparison Examples 1-3, being set to 2.6 mm. The distance L8 is set to 1.2 mm in Example 1, set to 1.28 mm in Comparison Examples 1 and 2 and set to 1.1 mm in Comparison Example 3, respectively.

[Shape from Center Portion of Connection Portion Toward Leading End Portion]

In the cases of the press-fit terminals 101, 103, 11 of Comparison Example 1 (FIG. 4), Comparison Example 3 (FIG. 6) and Example 1 (FIG. 7), the outer second portion 32 is formed arcuate, and in the inner second portion 42, an arcuate portion parallel with the outer second portion 32, a straight portion parallel with the center axis Y and an end portion 29 of the slit 24 are formed in this order. In Comparison Example 2 (FIG. 5), the outer second portion 32 is formed arcuate, and in the inner second portion 42, an arcuate portion parallel with the outer second portion 32 and a straight portion parallel with the center axis Y and dividing the leading end portion 21 along the center axis Y are formed in this order. Incidentally, in Example 1 (FIG. 7) as a difference from the foregoing embodiment (FIG. 1), the end portion 29 of the slit 24 has a shape parallel with the center axis Y. However, the basic concept remains the same as that of the foregoing embodiment and it may be considered that the press-in load will vary similarly thereto.

[Shape from Center Portion of Connection Portion Toward Base End Portion]

In Comparison Example 1 (FIG. 4) and Comparison Example 2 (FIG. 5), the outer first portion 31 is formed arcuate, and in the inner first portion 41, an arcuate portion parallel with the outer first portion 31 and an end portion 28 of the slit 24 are formed in this order. In Comparison Example 3 (FIG. 6), an arc which bulges the outer first portion 31 to the outer side and an arc which is curved concave toward the center axis Y are provided in this order, and an angular portion C is formed between the two arcs. In the press-fit terminal 11 of Example 1 (FIG. 7), the outer first portion 31 and the inner first portion 41 have same respective shapes as those of the press-fit terminal 10 of FIG. 1. In Example 1 (FIG. 7), the angle θ1 is set to 17.9 degrees.

Figure 8:
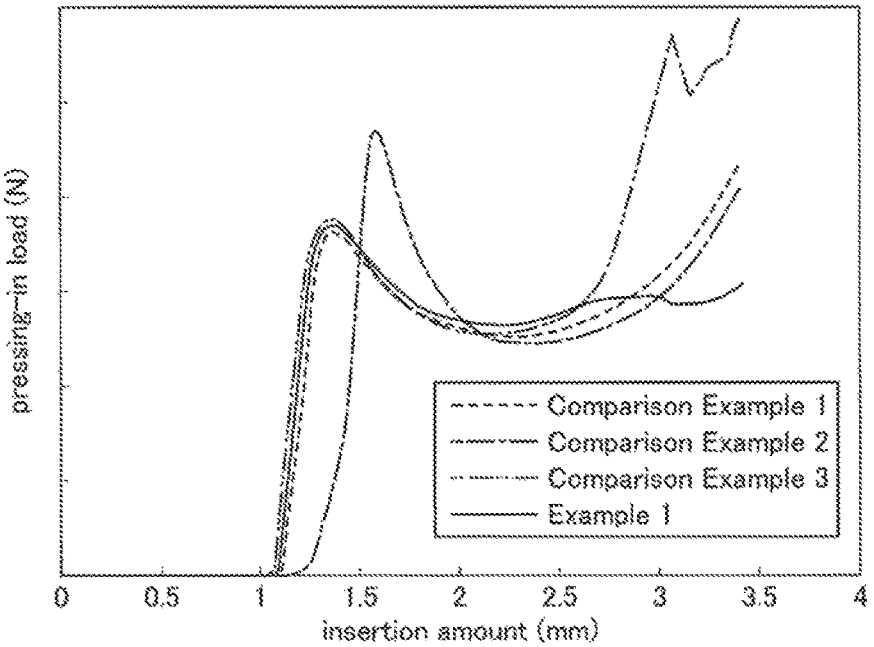
FIG. 8 is a graph showing relation between an insertion amount and a pressing-in load.

FIG. 8 shows changes of the pressing-in load (the load applied to the press-fit terminal in the pressing-in direction) relative to varied insertion amounts when pressed into a through hole (1 mm in diameter). Referring to FIG. 8, in the range up to the insertion amount of 2.2 mm, the pressing-in load varies substantially similarly in Comparison Examples 1, 3 and Example 1. Whereas, the pressing-load increases significantly in Comparison Example 2. This is due to the fact that the leading end portion 21 of Comparison Example 2 is divided in its shape across the center axis Y. It is inferred that the elastic force increased at the time of contact of the bifurcated leading end portions 21, resulting in the sharp increase in the pressing-in load.

In Comparison Examples 1-3 and Example 1, the distance L7 from the leading end portion 21 to the center portion 27 is 2.6 mm. Thus, when the insertion amount exceeds 2.2 mm to approach the distance L7 up to the center portion 27, the pressing-in loads in Comparison Examples 1-3 and Example 1 rise again. In the insertion amount range from 2.2 mm to 2.6 mm, no significant difference in rise of then pressing-in load is seen in Comparison Examples 1-3 and Example 1. However, when the insertion amount exceeds 2.6 mm, the pressing-in load rises most sharply in Comparison Example 3. And, the amounts of increase in the pressing-load are second largest in Comparison Examples 1 and 2. In Comparison Example 3, it is inferred that the pressing-in load increased most sharply due to the angular portion C present in the outer first portion 31 extending from the center portion 27 toward the base end portion 23. In Comparison Examples 1 and 2, it is inferred that as the outer first portion 31 extending from the center portion 27 toward the base end portion 23 is formed arcuate entirely, the pressing-in load increased due to interference of the through hole 2 by the outer first portion 31.

On the other hand, in Example 1, even in excess of the insertion amount of 2.6 corresponding to the position of the center portion 27, increase of the pressing-load was gentle and stable. From this, it may be understood that with the press-fit terminal 11 of Example 1, the pressing-in load at the time of completion of the pressing-in operation into the through hole 2 of the substrate 1 is suppressed.

Example 2

Figure 9:
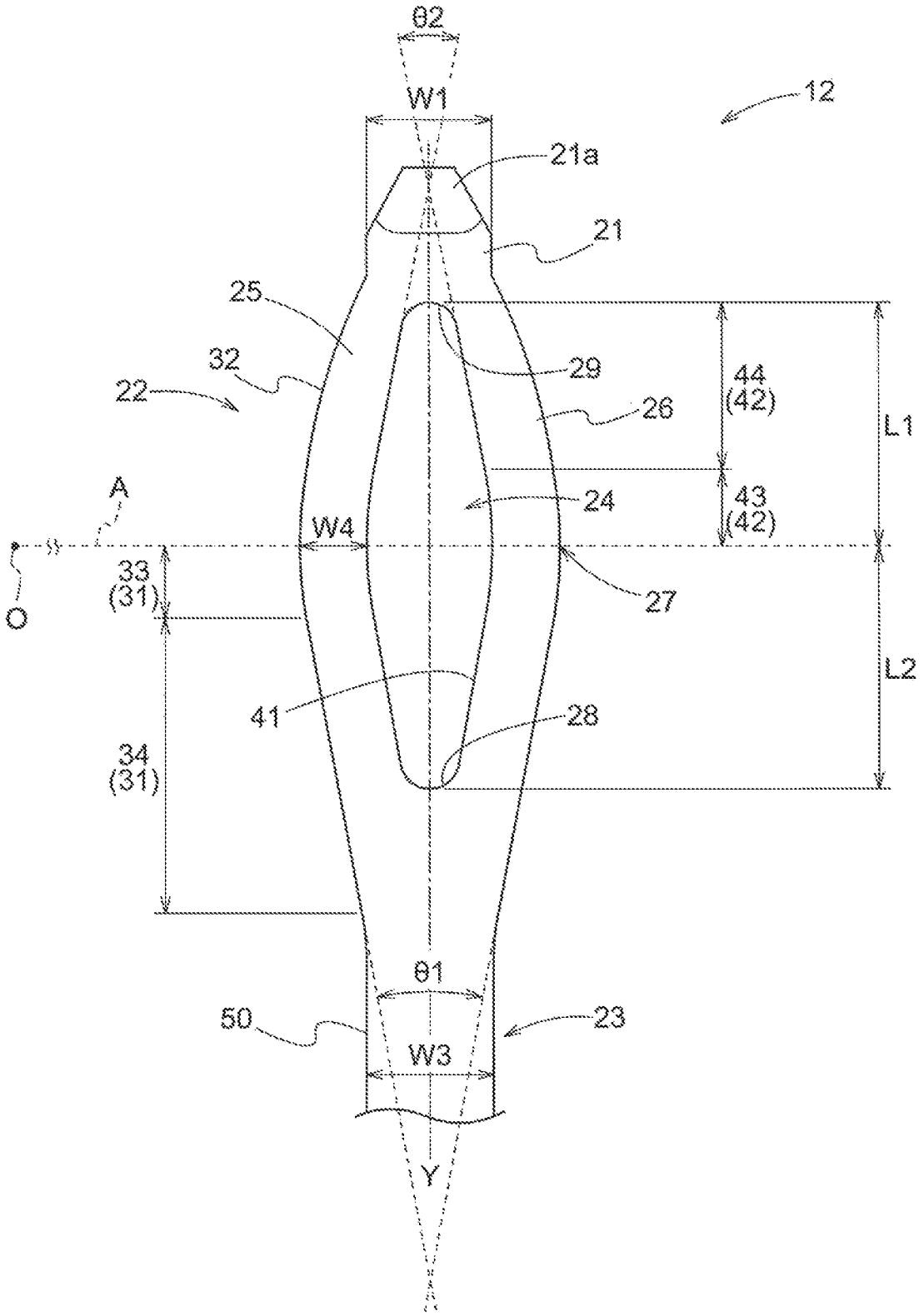
FIG. 9 is a front view of a press-fit terminal in Example 2.

A press-fit terminal 12 of Example 2 is shown in FIG. 9. In this press-fit terminal 12, the thickness and the width W1 of the leading end portion 21 are 0.8 mm and the leading end portion 21 is provided in the form of a square as seen in a plan view (not shown). The width W3 of the base end portion 23 is 0.9 mm, the width W4 of the conductive portions 25, 26 is 0.45 mm, and the angle θ1 is 20 degrees and the angle θ2 is 25 degrees. In the slit 24, the distance L1 from the center portion 27 toward the leading end portion 21 is set to 1.7 mm, the distance L2 from the center portion 27 toward the base end portion 23 is set to 1.54 mm, the distance L1 being set to about 1.1 folds of the distance L2.

In this way, in the case of the press-fit terminal 12 of Example 2, in comparison with Example 1, the thickness and the width W1 of the leading end portion 21 are increased and the angles θ1 and θ2 are also increased, whereas the ratio of the distance L1 relative to the distance L2 is set smaller. With this, in the press-fit terminal 12 of Example 2, the length of the terminal along the center axis Y can be set to a length approximately equal to that of Example 1. Namely, in the press-fit terminal 10, by adjusting the angles θ1 and θ2 and the ratio of the distance L1 relative to the distance L2 in accordance with the thickness and the width W1 of the leading end portion 21, the length along the center axis Y can be maintained.

In the foregoing Examples 1 and 2, there were shown the examples of press-fit terminals 11, 12 in which the width W1 and the thickness T of the leading end portion 21 are set to 0.64 mm and 0.8 mm. However, the press-fit terminals 11, 12 are not limited to the configurations of Examples 1 and 2, but may be modified appropriately.

INDUSTRIAL APPLICABILITY

The present invention is applicable to a press-fit terminal, when pressed into a through hole, rendered into a conductive state.

DESCRIPTION SIGNS LIST

10, 11, 12: press-fit terminal
21: leading end portion
22: connection portion
23: base end portion
24: slit
25, 26: conductive portion
27: center portion
31: outer first portion
32: outer second portion
33: first arcuate portion
34: first straight portion
41: inner first portion
42: inner second portion
43: second arcuate portion
44: second straight portion
A: virtual plane
L1: distance of leading end side of slit
L2: distance of base end side of slit
Y: center axis
θ1: tilt angle of first straight portion
θ2: tilt angle of second straight portion

The invention claimed is:

1. A press-fit terminal comprising:

a leading end portion to be inserted into a through hole formed in a substrate, the leading end portion having a smaller width than a width of the through hole;

a base end portion provided on the opposite side to the leading end portion; and a connection portion provided between the leading end portion and the base end portion to be pressed-into the through hole;

wherein the connection portion includes a slit extending through from the front side to the rear side, and a pair of conductive portions opposed to each other across the slit;

wherein a width of the connection portion is maximal at a center portion thereof between the leading end portion and the base end portion and progressively decreases from the center portion toward the leading end portion and toward the base end portion;

wherein an outer contour of each one of the pair of conductive portions in the connection portion includes respectively an outer first portion in which a first arcuate portion formed arcuate and a first straight portion formed straight are disposed in this order from the center portion toward the base end portion and an outer second portion extending from the center portion toward the leading end portion;

wherein an inner contour of the pair of conductive portions in the connection portion includes an inner first portion extending from the center portion toward the base end portion and an inner second portion extending from the center portion toward the leading end portion;

wherein the inner first portion is formed parallel with the outer first portion; and wherein each one of the pair of first straight portions is formed with a tilt by an angle ranging from 5 degrees or more to 10 degrees or less relative to a center axis of the slit.

2. The press-fit terminal of claim 1, wherein:

the outer second portion is formed of an outwardly bulging arc having a center of curvature on a virtual plane that is perpendicular to the center axis and extends through the center portion;

in the inner second portion, a second arcuate portion formed arcuate and parallel with the outer second portion and a second straight portion formed straight are disposed in this order from the center portion toward the leading end portion; and one pair of the second straight portions extend toward the leading end portion from a position where an angle formed by extension lines of tangents to a pair of the second arcuate portions across the center line therebetween ranges from 10 degrees or more to 25 degrees or less, with keeping this angle.

3. The press-fit terminal of claim 1, wherein in the slit, a distance thereof from the center portion toward the leading end portion is set to be 1.1 folds or more but less than 1.8 folds or less of a distance from the center portion toward the base end portion.

4. The press-fit terminal of claim 3, wherein in the slit, the distance from the center portion toward the base end portion is set to range from 0.9 mm or more to 1.6 mm or less.

* * * * *